US011521795B2

(12) United States Patent
Loth et al.

(10) Patent No.: US 11,521,795 B2
(45) Date of Patent: Dec. 6, 2022

(54) METHOD AND ROBOT SYSTEM FOR PRODUCING TRANSFORMER CORE

(71) Applicant: HEINRICH GEORG GMBH MASCHINENFABRIK, Kreuztal (DE)

(72) Inventors: Volker Loth, Freudenberg (DE); Jost Friedrich, Hilchenbach (DE)

(73) Assignee: HEINRICH GEORG GMBH MASCHINENFABRIK, Kreuztal (DE)

( * ) Notice: Subject to any disclaimer, the term of this patent is extended or adjusted under 35 U.S.C. 154(b) by 139 days.

(21) Appl. No.: 16/637,866

(22) PCT Filed: Aug. 9, 2018

(86) PCT No.: PCT/EP2018/071688
§ 371 (c)(1),
(2) Date: Feb. 10, 2020

(87) PCT Pub. No.: WO2019/030350
PCT Pub. Date: Feb. 14, 2019

(65) Prior Publication Data

US 2020/0251280 A1 Aug. 6, 2020

(30) Foreign Application Priority Data

Aug. 10, 2017 (DE) ..... 10 2017 007 548.4

(51) Int. Cl.
*H01F 41/02* (2006.01)
*H01F 27/245* (2006.01)
(Continued)

(52) U.S. Cl.
CPC ..... *H01F 41/0233* (2013.01); *B21C 47/18* (2013.01); *B21D 28/02* (2013.01);
(Continued)

(58) Field of Classification Search
CPC .... H01F 27/245; H01F 27/26; H01F 41/0233; B21D 28/02; B65H 16/023; B65H 2301/5151
See application file for complete search history.

(56) References Cited

U.S. PATENT DOCUMENTS 4,527,936 A * 7/1985 Hartlieb ..... B21D 43/20 198/436
4,578,860 A * 4/1986 Tanaka ..... H01F 41/0233 29/738
(Continued)

FOREIGN PATENT DOCUMENTS

CN 101642828 A 2/2010
CN 101976606 A 2/2011
(Continued)

*Primary Examiner* — Jeffrey T Carley
(74) *Attorney, Agent, or Firm* — Dickinson Wright PLLC; Andrew D. Dorisio

(57) ABSTRACT

The invention relates to a method and a robot system (23) for producing transformer cores (12), sheets of metal (16) from which a transformer core is constructed being received on at least two stacking tables (18) by means of a multiaxial robot (22) of the robot system, the sheets of metal being supplied to the robot and stacked adjacent to the robot in at least two storage positions (31) for different sheets of metal by means of a conveyor device (29), the robot and the conveyor device being controlled by a control device (17), sheets of metal being collected from the storage positions and being stacked on the stacking tables by means of the robot disposed between and above the stacking tables.

14 Claims, 1 Drawing Sheet

(51) Int. Cl.

| | |
|---|---|
| ***H01F 27/26*** | (2006.01) |
| ***B21D 28/02*** | (2006.01) |
| ***B21C 47/18*** | (2006.01) |
| ***B65H 16/02*** | (2006.01) |

(52) U.S. Cl.
CPC ..... *B65H 16/023* (2013.01); *H01F 27/245* (2013.01); *H01F 27/26* (2013.01); *H01F 41/0213* (2013.01); *B65H 2301/5151* (2013.01); *B65H 2701/173* (2013.01); *Y10T 29/5317* (2015.01)

(56) References Cited

U.S. PATENT DOCUMENTS

| | | | | |
|---|---|---|---|---|
| 2011/0024051 | A1* | 2/2011 | Sanford | H01F 41/0213 156/355 |
| 2016/0039050 | A1* | 2/2016 | Yang | B23K 26/38 219/121.72 |
| 2017/0157767 | A1* | 6/2017 | Takamizawa | G06N 3/08 |

FOREIGN PATENT DOCUMENTS

| | | | | | |
|---|---|---|---|---|---|
| CN | 103559999 | A | | 2/2014 | |
| CN | 104661769 | A | | 5/2015 | |
| DE | 2530309 | A1 | | 1/1977 | |
| DE | 2613150 | A1 | | 9/1977 | |
| EP | 0010252 | A1 | * | 4/1980 | H01F 41/0233 |
| EP | 0184563 | A1 | | 6/1986 | |
| EP | 1728606 | A1 | * | 12/2006 | B27B 31/00 |
| EP | 1764808 | A1 | * | 3/2007 | H02K 15/02 |
| EP | 2009652 | A2 | * | 12/2008 | H01F 41/0233 |
| EP | 2009652 | A2 | | 12/2008 | |
| EP | 2399850 | A1 | * | 12/2011 | B21D 43/22 |
| EP | 2660836 | A2 | | 11/2013 | |
| EP | 2899729 | A1 | | 7/2015 | |
| JP | S52118217 | A | | 10/1977 | |
| JP | S5918624 | A | | 1/1984 | |
| JP | 2002100521 | A | | 4/2002 | |
| JP | 2002369461 | A | * | 12/2002 | |
| WO | WO-2010107504 | A1 | * | 9/2010 | H01F 41/0213 |
| WO | WO-2012072699 | A2 | * | 6/2012 | B21D 28/02 |

* cited by examiner

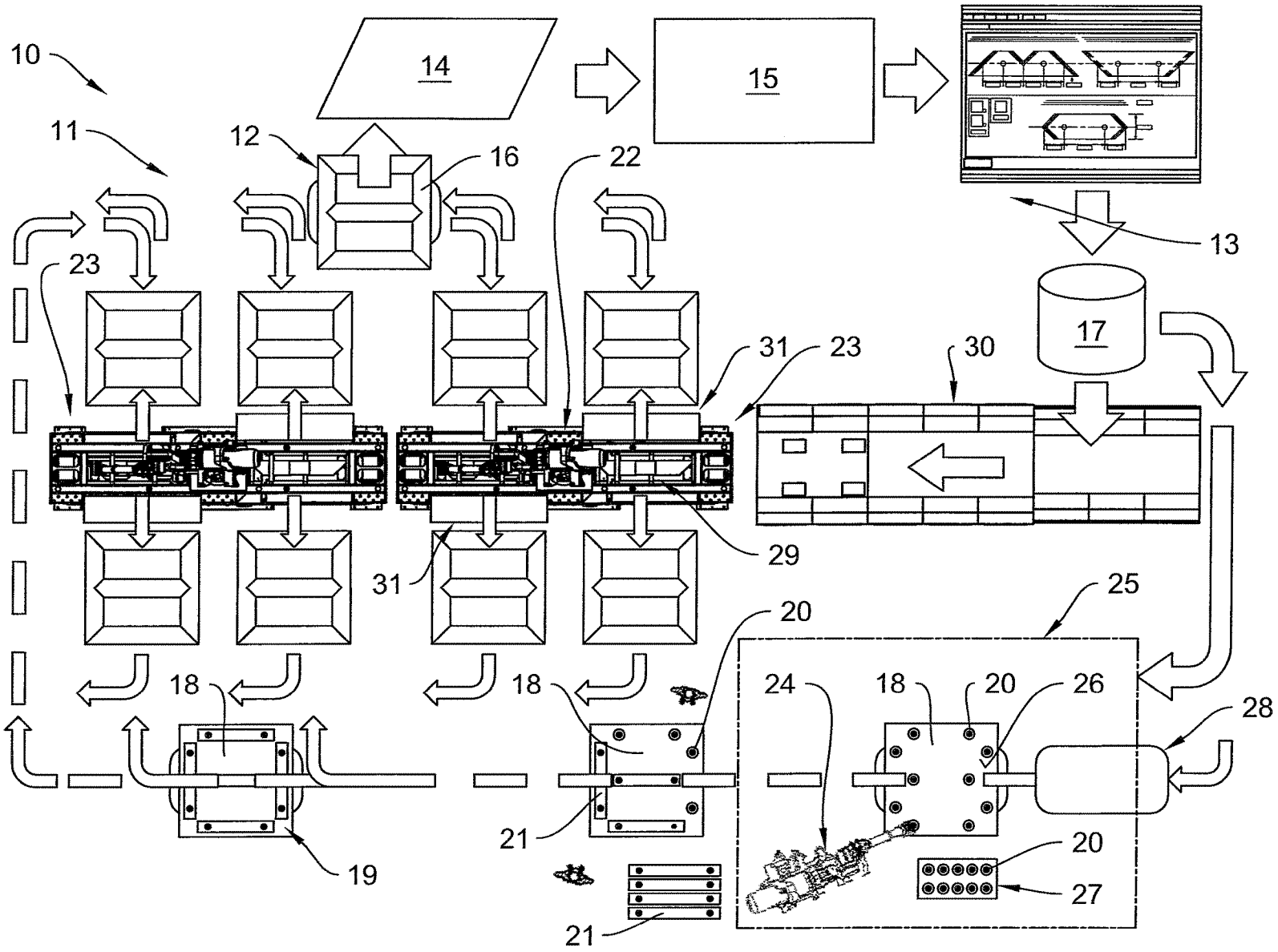
10
11
12
13
14
15
16
17
18
19
20
21
22
23
24
25
26
27
28
29
30
31

METHOD AND ROBOT SYSTEM FOR PRODUCING TRANSFORMER CORE

TECHNICAL FIELD OF THE INVENTION

The invention relates to a method and a robot system for producing transformer cores.

The installations known from the state of the art for producing transformer cores are constructed according to a progress sequence in such a manner that sheets of metal for transformers first are cut from sheet-metal strips by means of a cutting device. The sheet-metal strips are stored on a steel-strip roll which is held by a reel head of a reel. The reel can have a plurality of reel heads having steel-strip rolls so that different sheet-metal strips of the cutting device can be supplied as required. The sheet-metal strips can be exchanged at or supplied to the cutting device manually or via a conveyor belt, for example; however, the exchange of the sheet-metal strip and/or the steel-strip roll requires much time.

BACKGROUND OF THE INVENTION

The sheets of metal cut in the cutting device can have different geometries since a transformer core is often constructed from sheets of metal of different shapes. The sheets of metal can be guided away from the cutting device by a conveyor belt and be stored and/or stacked for further processing. The transformer core is constructed from the sheets of metal on a so-called stacking table. On the stacking table, threading bolts and/or sheet-metal abutments are mounted in a fixed manner as positioning aids and the sheets of metal are constructed and/or stacked on the threading bolts and/or sheet-metal abutments to construct the transformer core. In order to be able to locate the sheets of metal, at least two positioning aids are always required. The sheets of metal in particular have bores and/or cutouts in which the threading bolts can engage. The sheets of metal are stacked on threading bolts and/or stacked along the sheet-metal abutments and thus accurately positioned in relation to one another. Sheets of metal can generally be stacked manually but also in an automated manner. It is essential that a sufficient number of different sheets of metal is made available at all times for constructing the transformer core so as to avoid idle time, for example.

Since the stacking table is always constructed for a transformer core having a position of the positioning aids displaceable in guide rails, a stacking table can always only be used after retrofitting the positioning aids for producing one kind of transformer core. If different kinds of transformer cores are to be produced using one installation, a correspondingly large number of stacking tables is required for core shapes outside of the displacement ranges of the positioning aids which have to be held available.

SUMMARY OF THE INVENTION

The object of the invention at hand is therefore to propose a method and a robot system for producing transformer cores which both enable a cost-effective production of transformer cores.

This object is attained by a method having the features of claim 1 and a robot system having the features of claim 14.

In the method according to the invention for producing transformer cores using a robot system, sheets of metal from which a transformer core is constructed are received on at least two stacking tables by means of a multiaxial robot of the robot system, the sheets of metal being supplied to the robot and being stacked adjacent to the robot in at least two storage positions for different sheets of metal by means of a conveyor device, the robot and the conveyor device being controlled by a control device, sheets of metal being collected from the storage positions and stacked on the stacking tables by means of the robot disposed between and above the stacking tables.

The sheets of metal are first cut from sheet-metal strips by a cutting device and supplied by means of the conveying device which can be a conveyor belt, a roller belt or similar. The conveyor device is realized such that the sheets of metal are placed or stacked in the at least two storage positions. It is intended in this instance that sheets of metal of the same kind having the same basic shape are each supplied to the storage positions so only stacks of essentially matching sheets of metal are formed in the storage positions, though different sheets of metal can be stacked in a storage position. The storage positions are disposed relative to the robot such that it can collect sheets of metal or sheet-metal bundles from the storage positions. The robot and the conveyor devices are controlled by the control device so the robot always accesses storage positions in which sheets of metal are actually available. Since at least two stacking tables and two storage positions are available, there is no risk of idle time of the robot arising due to an empty storage position. In this case, the robot can remove sheets of metal from the still full storage position and stack it on the stacking table. In the event that sheets of metal, which would otherwise be in the empty storage position, might have to be stacked on a stacking table, the robot can continue stacking sheets of metal from the still full storage position on the other stacking table. This also helps to prevent idle time of the robot when sheets of metal are still in a storage position. A suitable allocation of sheets of metal available in the respective storage positions to stacking tables is controlled via the control device. In the storage positions, the conveyor device can comprise means for identifying a number of sheets of metal for this purpose.

Furthermore, a work progress of the sheets of metal stacked on the stacking tables or rather of the respective transformer core can be determined by the control device by means of the work steps executed by the robot. By involving the control device in conjunction with the at least two storage positions and the two stacking tables, idle time can be prevented particularly effectively and thus producing transformer cores can be made more cost-efficient.

Thus the control device can adjust a stacking sequence of the sheets of metal on the stacking tables as a function of an availability of the sheets of metal in the storage positions. The control device can comprise means for data processing, such as a computer, and/or be a stored program control (SPC). The shape of the transformer core to be produced can be yielded from the desired physical properties and the measurements to be derived therefrom which can be determined or rather calculated using a core configurator for transformer cores. In particular, the core configurator can be a software. Similarly, the measurements for sheets of metal of the transformer core can be derived from the core configurator which can then be used by the control device for calculating a stack shape and/or a stacking sequence.

The robot can remove a single sheet of metal or a sheet-metal bundle from the storage position. It can thus be intended, for example, that a sheet-metal bundle having a defined number of sheets of metal can be made available in a storage position so that the robot can remove this sheet-metal bundle and set it down or rather stack it on the stacking table. The robot can have a robot arm at whose end a vacuum exhauster or even a suitable grappler is disposed, for example.

Moreover, it can be intended to construct a plurality of transformer cores on a single stacking table. In particular if a control system is available for an installation for producing transformer cores, this control system can calculate an optimal distribution of transformer cores on a stacking table.

The robot can position and/or remove at least two threading bolts and/or sheet-metal abutments as positioning aids for the sheets of metal on and/or from a positioning surface of the respective stacking table, the robot being able to stack the sheets of metal on the threading bolts and/or the sheet-metal abutments after positioning the threading bolts and/or the sheet-metal abutments. Thus a retaining system for fastening the threading bolts on the stacking table is realized such that a generally free positioning of the threading bolts and/or the sheet-metal abutments and their location-independent fastening are possible in any position of the positioning surface. A position of the exemplary threading bolts is therefore no longer bound to the fastening positions or to a fastening roster, of which either is intended on the stacking table, whereby a flexible and arbitrary disposition of the threading bolts adapted to the geometry of the transformer core to be produced is possible on the stacking table. Owing to the possibility of being able to position the threading bolts in any position on the stacking table or rather on the positioning surface of the stacking table by means of the robot, it becomes possible to construct stacking tables as required for different kinds of transformer. Unlike with the generic, location-dependent fastening of the threading bolts, these stacking tables no longer have to be stored in large numbers since the stacking tables can be equipped with the threading bolts via the positioning system directly before stacking a transformer core. After removing the finished transformer core from the stacking table, the threading bolts can be removed again from the stacking table by means of the robot and be re-positioned if necessary in order to construct a transformer core having a deviating shape. Hence producing different transformer cores generally becomes possible using only one stacking table. The number of stacking tables can be drastically reduced, retrofitting efforts for threading bolts and/or sheet-metal abutments are lowered, and the costs for producing different transformer cores is drastically reduced.

Control commands can be transmitted to the control device from a control system of an installation for producing transformer cores as a function of component data describing a transformer core. The control system can comprise a core configurator, for example. It can be further intended for the control system to control the entire installation for producing transformer cores. The component data of a transformer core available in the control system can be converted to control commands which are transmitted to the control device. The control system can determine and/or calculate a position of threading bolt on a positioning surface and transmit control commands to the control device to equip a stacking table with threading bolts in the calculated positions. The control system can also have means for data processing, e.g., a computer with software. The component data can concern a stacking sequence of different sheets of metal.

A positioning of threading bolts and/or sheet metal abutments on the stacking tables, the storage position for the respective sheets of metal, and/or a cutting sequence of a cutting device for sheets of metal can be identified by means of the control system. It is then also possible, for example, to co-ordinate the different work stations of the installation for producing transformer cores with one another by means of the control system such that an optimal material flow having little processing time can be realized. The cutting frequency of a cutting device for sheets of metal can be adjusted to an amount of sheets of metal in storage positions at a robot, for example, so that a sufficient amount of sheets of metal is always available in the storage positions. More than two storage positions can also be intended if the transformer core is constructed from a larger number of different sheets of metal. Furthermore, it is possible to optimize a material flow by means of the control system to the extent that idle time of the installation and in particular of the robot system is precluded to the greatest extent possible. Furthermore, the stacking tables can be equipped with exemplary threading bolts in such a manner that certain kinds of transformer cores can be produced as a function of a material flow. If steel-strip rolls required for producing a transformer core are no longer available, for example, the control system can initiate the production of other transformer cores for which enough material is available. The control system can transmit control commands to the control device to retrofit stacking tables and initiate producing and providing corresponding sheets of metal.

The robot system according to the invention for producing transformer cores comprises a multiaxial robot; at least two stacking tables for receiving sheets of metal from which a transformer core can be constructed; a conveyor device for supplying sheets of metal; and a control device for controlling the robot and the conveyor device, the conveyor device comprising at least two storage positions, which are intended for different sheets of metal, adjacent to the robot, the respective sheets of metal being able to be supplied to the storage positions and being able to be stacked in the storage positions, the robot being disposed between and above the stacking tables, sheets of metal being able to be collected from the storage positions by means of the robot and being able to be stacked on the stacking tables. Regarding the advantages of the robot system, the description of advantages of the method according to the invention is referred to.

The robot can be disposed between two parallel rows of either two or more stacking tables. If more than two stacking tables are being used, it is advantageous to dispose them in parallel rows and to position the robot between the parallel rows so the robot can access the storage positions and the stacking tables.

Provided a movement area of the robot is not sufficient with regard to a length of the parallel rows, the robot can be realized so as to be displaceable parallel to the rows. Since the robot must generally be disposed between and above the stacking tables so the robot can stack sheets of metal on the stacking tables from above, the conveyor device can be disposed below the robot between the two stacking tables or rather the parallel rows.

Depending on the number of stacking tables, the robot system can have a plurality of robots which are disposed so as to be displaceable between the rows and above the storage positions. Provided that a sufficient number of sheets of metal is provided in the storage positions, constructing the transformer cores from sheets of metal can be further accelerated by using several robots.

The conveyor device can form one storage position per stacking table, the storage positions being able to be disposed adjacent to the stacking table. A transport path of a sheet of metal from the storage position to the stacking table can thus be minimized, whereby the robot can be used particularly efficiently.

The storage position can be realized having abutments and/or a centering device for the exact disposition of sheets of metal. The exact disposition of sheets of metal favors an exact placing of the sheets of metal on the stacking tables. Furthermore, it is more easily possible to put together a sheet-metal bundle in the storage position without having to further correct the sheets of metal of the sheet-metal bundle with respect to their position relative to one another. The conveyor device can also be realized such that the storage positions can be set up at or be removed from a conveyor belt for sheet of metal, for example, in an automated manner as required. Sheets of metal can be simply identified on the conveyor belt by means of image processing, the sheets of metal then being able to be discharged to the respective storage positions by means of corresponding conveyor means.

The stacking tables can each comprise at least two threading bolts and/or sheet-metal abutments which serve as positioning aids for the sheets of metal, the stacking table forming a positioning surface for the threading bolts and/or the sheet-metal abutments and being able to be equipped with the threading bolts and/or the sheet-metal abutments.

The stacking able and the threading bolts and/or the sheet-metal abutments can be realized such that a free positioning and location-independent fastening of the threading bolts and/or the sheet-metal abutments are possible within the positioning surface in any position of the positioning surface. The position of the exemplary threading bolts is then no longer bound to fastening positions or to a fastening roster, of which either is intended on the stacking table, whereby a flexible and arbitrary disposition of the threading bolts adapted to the geometry of the transformer core to be produced becomes possible on the stacking table. Owing to the possibility of being able to dispose the threading bolt in any position on the stacking table or rather on the positioning surface of the stacking table, it becomes possible to construct stacking tables for different kinds of transformers as required.

The stacking table can be transported by means of a self-propelling cart of the robot system. The stacking table can be controlled by means of the control device according to the specifications of a core configurator and approach the specified positions in the production progress. Steel-strip rolls can also be transported to a reel by means of the cart.

Further advantageous embodiments of a robot system can be derived from the descriptions of features of the dependent claims referring back to claim 1.

BRIEF DESCRIPTION OF THE DRAWING FIGURES

In the following, an embodiment of the invention is further described with reference to the attached drawing.

The FIGURE shows a schematic illustration of an installation 10 having a device 11 for producing transformer cores 12. Installation 10 comprises a control system 13 which serves for controlling installation 10. Component data 14 describing transformer cores 12 are processed using control system 13 by means of a so-called core configurator 15 so sheets of metal 16 from which transformer core 12 is constructed are calculated using their measurements. Control system 13 transmits control commands and/or data for producing transformer core 12 to a control device 17 which then initiates producing transformer core 12 using corresponding control commands.

DETAILED DESCRIPTION OF THE INVENTION

Device 11 comprises among other elements a number of stacking tables 18 having a retaining system 19 for collecting sheets of metal 16. Retaining system 19 comprises at least two threading bolts 20 and, in this shown embodiment, substructions 21 for placing sheets of metal 16.

Sheets of metal 16 are realized having bores not illustrated in this instance and are placed and/or inserted on threading bolts 20. Sheets of metal 16 are placed on threading bolts 20 or rather on stacking table 18 by means of a robot 22 of a robot system 23. Threading bolts 20 are also positioned on a positioning surface 26 of stacking table 18 by means of a robot 24 of a positioning system 25. Positioning surface 26 is flat so a free positioning and a location-independent fastening of threading bolts 20 on positioning surface can be effected according to the specifications of control system 13. Threading bolts 20 are stored in a magazine 27 and are disposed on or removed from positioning surface 26 by means of robot 24. For this purpose, stacking table 18 is transported by means of a self-propelling cart 28. Cart 28 transports stacking table 18 to illustrated robot systems 23 at which stacking table 18 is equipped with sheets of metal 16 or rather sheets of metal 16 are stacked to construct transformer core 12. After transformer core 12 has been stacked, stacking table 18 is transported away from robot system 23 by cart 28.

A number of sheets of metal 16 is supplied to robot systems 23 from a cutting device 30 by means of a conveyor device 29 and are stacked adjacent to respective robot 22 in two storage positions 31 for different sheets of metal 16 in each instance. Robot 22 and/or storage position 31 is/are also controlled by means of control device 17. Robot 22 grapples sheets of metal 16 from respective storage positions 31 and positions them on threading bolts 20 on stacking table 18 until transformer core 12 is constructed. Robot 22 can be displaced above conveyor device 29 so that robot 22 can equip four stacking tables 18 with sheets of metal 16 simultaneously.

Only schematically illustrated cutting device 30 serves for cutting sheets of metal 16 and is controlled by control device 17. In cutting device 30, not-illustrated sheet-metal strips are cut such that sheets of metal 16 are yielded. Not-illustrated sheet-metal strips are supplied from steel-strip rolls to cutting device 30.

The invention claimed is:

1. A method of robotically stacking sheets of metal for producing a transformer core, the method comprising the steps of:

conveying the sheets of metal to a multiaxial robot by means of a conveying device;

stacking the sheets of metal adjacent to the robot in at least two storage positions;

providing a control device adapted to control the multiaxial robot and the conveyor device;

collecting the sheets of metal from the at least two storage positions with the multiaxial robot; and providing at least two stacking tables, each of the stacking tables comprising at least two threading bolts or sheet-metal abutments which serve as positioning aids for the sheets of metal, each stacking table forming a positioning surface for the threading bolts or the sheet-metal abutments, wherein each stacking table and either the threading bolts or the sheet-metal abutments are configured such that a free positioning and location-independent fastening of the threading bolts of the sheet-metal abutments within the positioning surface is possible at any position of the positioning surface;

stacking the sheets of metal on the at least two stacking tables with the multiaxial robot to form the transformer core, wherein the multiaxial robot is disposed between and above the stacking tables.

2. The method according to claim 1, further comprising the step of adjusting a stacking sequence of the sheets of metal on the stacking tables as a function of an availability of the sheets of metal in the storage positions.

3. The method according to claim 1, characterized in that the robot removes a single sheet of metal or a sheet-metal bundle from the storage position.

4. The method according to claim 1, wherein the stacking step comprises creating a plurality of stacks of sheets of metal for the construction of a plurality of transformer cores on one stacking table.

5. The method according to claim 1, further comprising transmitting control commands to the control device from a control system of an installation for producing transformer cores as a function of component data describing a transformer core.

6. The method according to claim 5, wherein the transmitting step comprises identifying a positioning of threading bolts or sheet-metal abutments on the stacking tables, the storage positions for the respective sheets of metal or a cutting sequence of a cutting device for sheets of metal.

7. A robot system for producing transformer cores, the robot system comprising;

a multiaxial robot;

at least two stacking tables for receiving sheets of metal from which a transformer core can be constructed, wherein each of the stacking tables comprises at least two threading bolts or sheet-metal abutments which serve as positioning aids for the sheets of metal, each stacking table forming a positioning surface for the threading bolts or the sheet-metal abutments and being equipped with the threading bolts or the sheet-metal abutments, and wherein each stacking table and either the threading bolts or the sheet-metal abutments are configured such that a free positioning and location-independent fastening of the threading bolts or the sheet-metal abutments within the positioning surface is possible at any position of the positioning surface;

a conveyor device for supplying sheets of metal; and a control device for controlling the robot and the conveyor device, wherein the conveyor device includes at least two storage positions intended for different sheets of metal and disposed adjacent to the robot, wherein the conveyor device is adapted to supply the respective sheets of metal to the storage positions and further adapted to stack the respective sheets of metal in the storage positions, wherein the robot is disposed between and above the stacking tables, and wherein the robot is adapted to collect the sheets of metal from the storage positions and is further adapted to stack the sheets of metal on the stacking tables.

8. The robot system according to claim 7, characterized in that the robot is disposed between two parallel rows of at least two or more stacking tables in each instance.

9. The robot system according to claim 8, characterized in that the robot is displaceable parallel to the rows.

10. The robot system according to claim 8, characterized in that the robot system comprises a plurality of robots which are disposed in a displaceable manner between the rows and above the storage positions.

11. The robot system according to claim 7, characterized in that the conveyor device includes one storage position per stacking table, the storage position being disposed adjacent to the stacking table.

12. The robot system according to claim 7, characterized in that the stacking table is transported by means of a self-propelling cart of the robot system.

13. The robot system according to claim 7, wherein the multiaxial robot includes only a single arm.

14. The robot system according to claim 7, wherein the robot is adapted to stack the sheets of metal in direct contact with one another.

* * * * *